US005706752A

United States Patent [19]

Menne, Jr. et al.

[11] Patent Number: 5,706,752

[45] Date of Patent: Jan. 13, 1998

[54] BIMINI SUN TOP FRAME FOR A PONTOON BOAT

[75] Inventors: Robert J. Menne, Jr.; Timothy J. Menne, both of Forest Lake, Minn.

[73] Assignee: Premier Marine, Inc., Wyoming, Minn.

[21] Appl. No.: 521,529

[22] Filed: Aug. 30, 1995

[51] Int. Cl.[6] ..... B63B 17/00

[52] U.S. Cl. ..... 114/361

[58] Field of Search ..... 114/361; 135/88

[56] References Cited

U.S. PATENT DOCUMENTS

| | | | |
|---|---|---|---|
| 2,513,764 | 7/1950 | Vonder Ahe | 114/361 |
| 2,817,345 | 12/1957 | Woodruff, Sr. | 114/361 |
| 2,821,989 | 2/1958 | Shepard | 114/361 |
| 2,829,660 | 4/1958 | Wester et al. | 114/361 |
| 5,303,667 | 4/1994 | Zirkelbach et al. | 114/361 |

*Primary Examiner*—Stephen Avila
*Attorney, Agent, or Firm*—Hugh D. Jaeger

[57] ABSTRACT

A collapsible bimini sun top frame for a pontoon boat including square aluminum tubes and extruded aluminum fittings securing the frame to the railings of the pontoon boat. The frame supports a soft top of water resistant canvas or other material for protection from sun and rain in an open position, and is collapsible to a storage position. The soft top can be secured, such as with hook and loop fasteners, to the collapsible frame and, with appropriate fasteners, to the railings of the pontoon boat. The extruded fittings also can be utilized with other frames for other types of boats, such as speed boats, water skiing boats, or any other type of structure requiring a frame.

2 Claims, 10 Drawing Sheets

BIMINI SUN TOP FRAME FOR A PONTOON BOAT

CROSS REFERENCES TO CO-PENDING APPLICATIONS

None.

BACKGROUND OF THE INVENTION

1. Field of the Invention

The present invention is for a collapsible frame for a cloth or canvas-like top for a boat, and more particularly, pertains to a collapsible frame for a bimini sun top for a pontoon boat.

2. Description of the Prior Art

Prior art pontoon boat frames have been constructed of formed aluminum. Such prior art frames, while being relatively or somewhat secure, are still fairly unstable and, hence, are susceptible to vibrating, wiggling, swaying, and generally rocking with a harmonic motion on the pontoon boat when in the water or while trailering. These movements are objectionable.

The present invention overcomes the disadvantages of the prior art by providing a secure and sturdy framework for a bimini sun top for a pontoon boat.

SUMMARY OF THE INVENTION

The general purpose of the present invention is to provide a collapsible frame for a bimini sun top which secures to the railings of a pontoon boat and which can be opened and collapsed with ease.

According to one embodiment of the present invention, there is provided a collapsible frame for a sun top for a pontoon boat which includes extruded components which engage with square tubular extruded aluminum members. The combination of the extruded components and the supporting framework provides a stable and sturdy frame for support of a cloth, canvas or polymer-like cloth sun top structure.

One significant aspect and feature of the present invention is a collapsible frame structure which can be unfolded from a closed storage position to an open position for supporting a canvas, cloth or polymer top.

Another significant aspect and feature of the present invention is a frame structure which is sturdy and as a stable unit rides with the pontoon boat rather than wobbling with the motion of the pontoon boat.

A further significant aspect and feature of the present invention is a combination of a frame structure and extruded fittings which slidably and closely engage with close tolerance over square tubular extruded aluminum members, thereby providing inherent stability for the collapsible frame.

Having thus described significant aspects and features of the present invention, it is the principal object of the present invention to provide an improved sun top frame for a pontoon boat.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
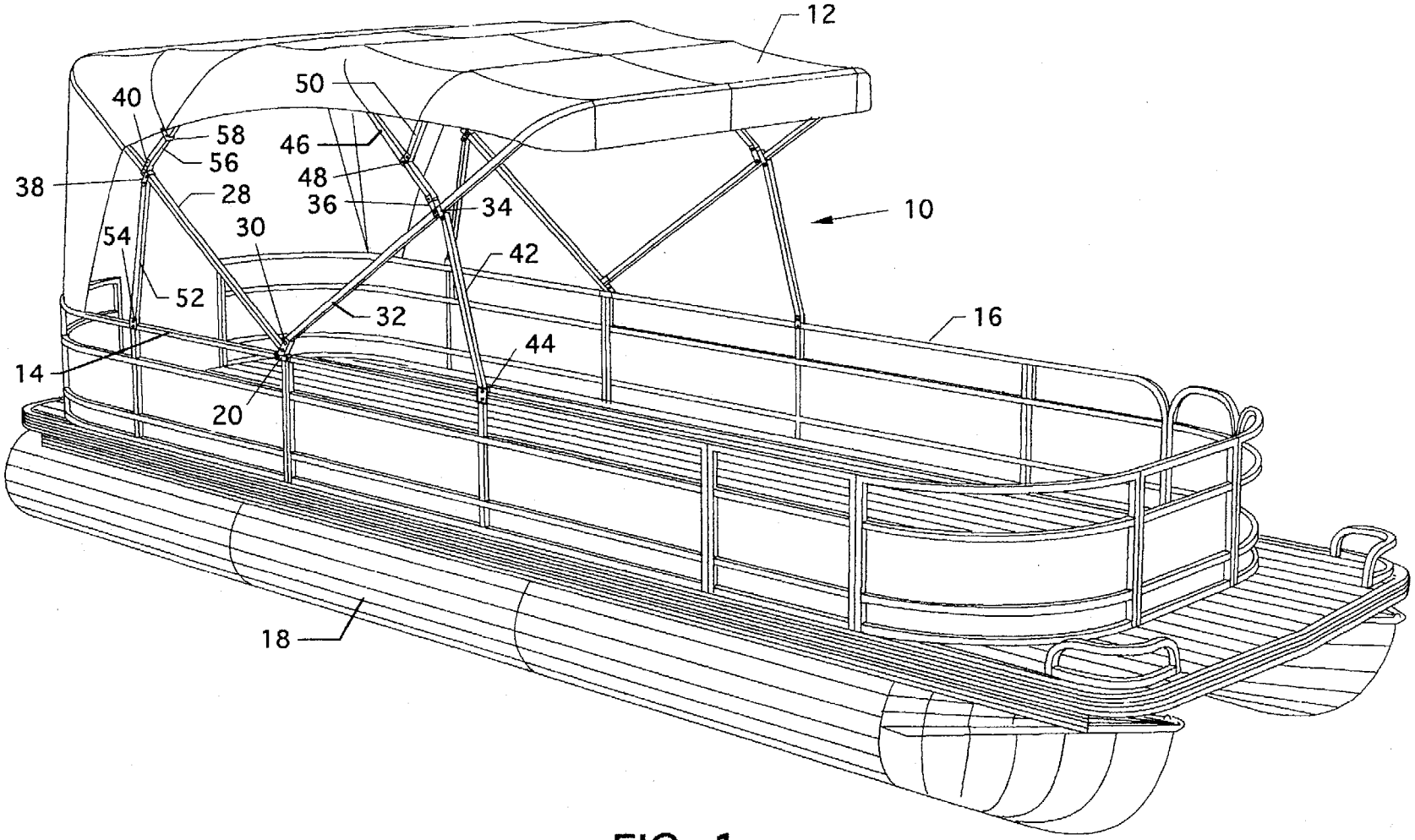
FIG. 1 is a perspective view of a frame in the unfolded raised position on a pontoon boat.

FIG. 1 is a perspective view of a frame 10 supporting a cover 12 and being secured to opposing railing frameworks 14 and 16 of a pontoon boat 18. The cover 12 may be cloth, canvas or polymer-like cloth material.

Figure 2:
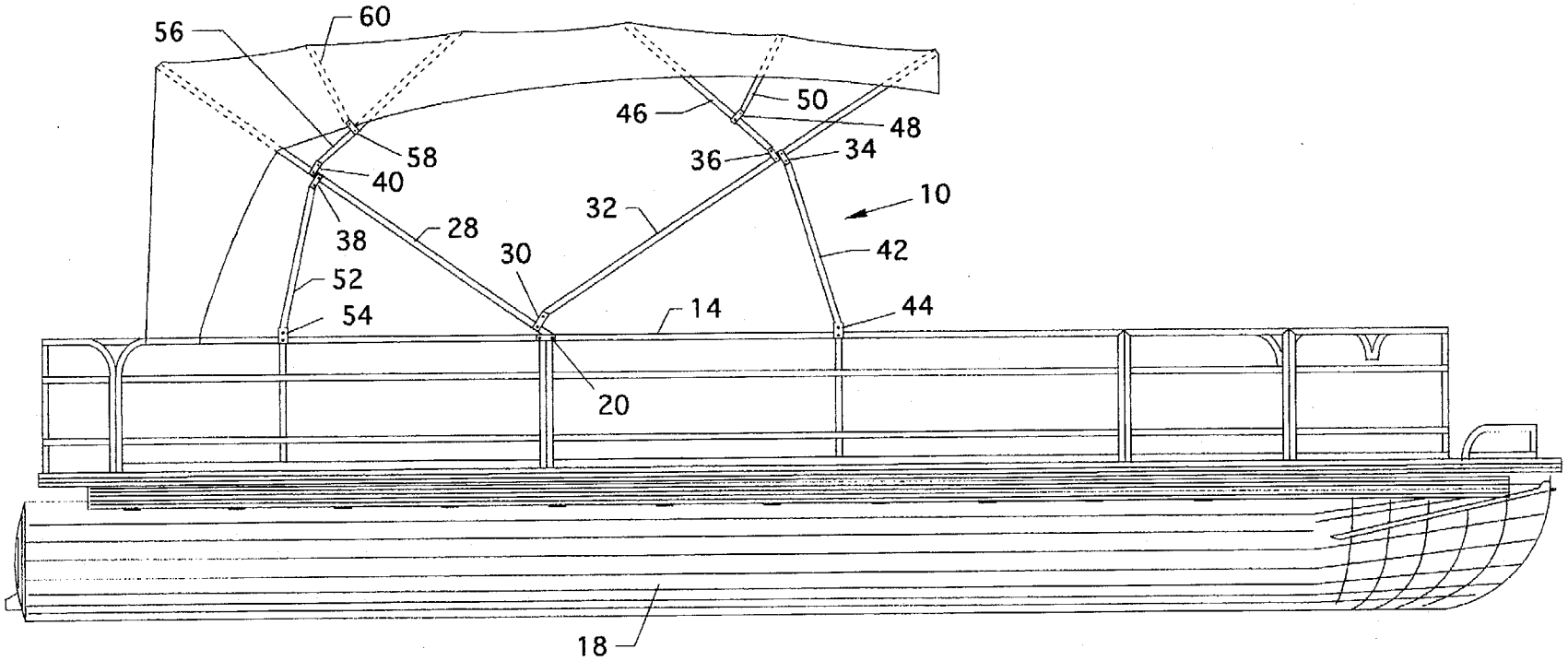
FIG. 2 is a starboard side view of a frame in the unfolded raised position on a pontoon boat.
Figure 3:
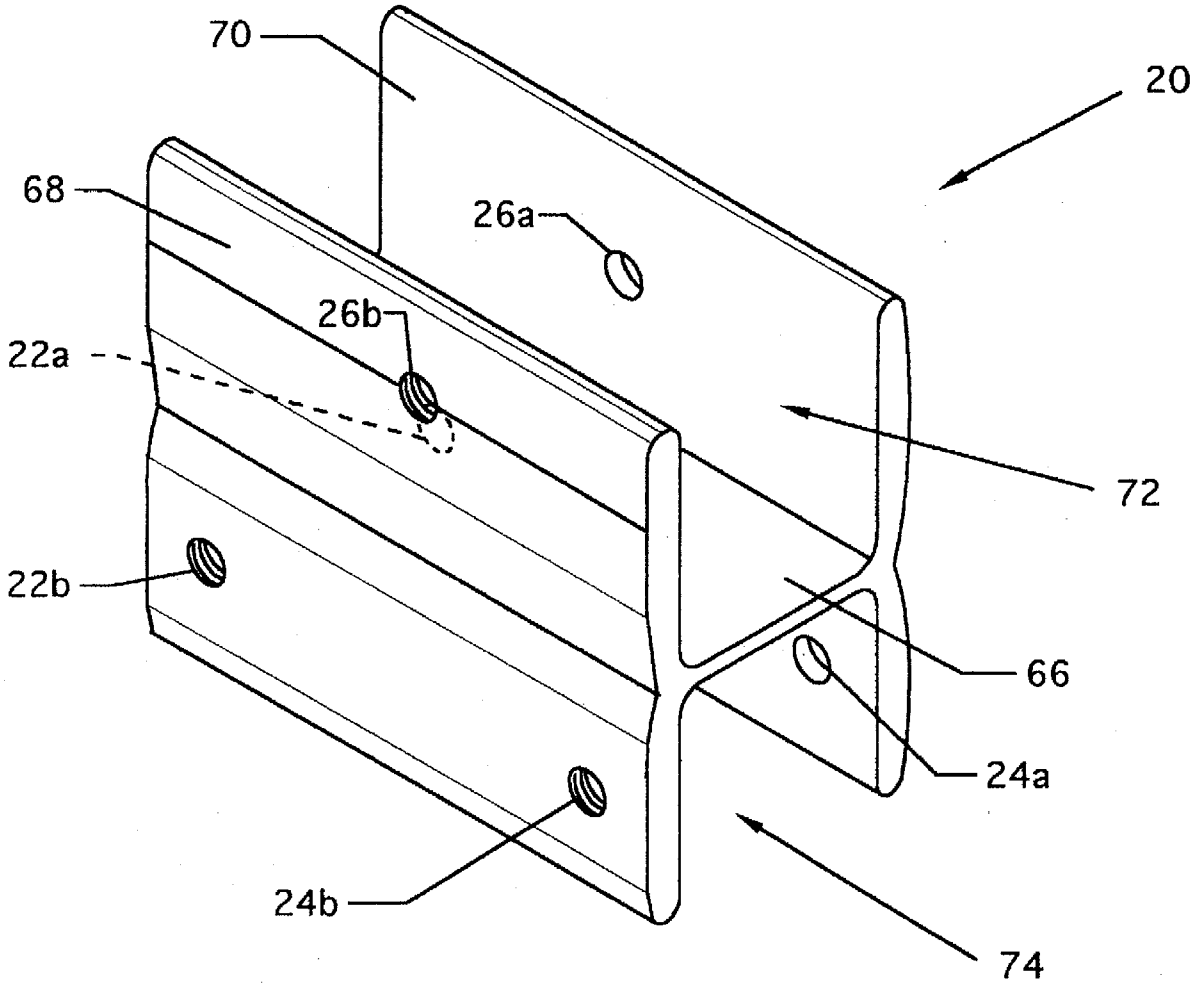
FIG. 3 is an isometric view of an extruded long H-bracket.

FIG. 2 is a starboard side view of the frame 10, where all numerals correspond to those elements previously described. Now, elements on the starboard side of the pontoon boat 18 will be described in detail, recognizing that there are identical opposing elements on the port side of the pontoon boat. A long H-bracket 20 of extruded aluminum with three sets of holes 22*a*, 22*b*, 24*a*, 24*b*, 26*a* and 26*b*, as illustrated in FIG. 3, is secured to the railing framework 14 with stainless steel machine screws or bolts through appropriate holes in the railing framework 14. The chemical reaction (electrolysis) between the aluminum H-bracket 20 and the stainless steel machine screws or bolts forms a chemical bond, thereby securing the machine screws or bolts to the long H-bracket 20. The long H-bracket 20 is described in greater detail with reference to FIG. 3.

Figure 7:
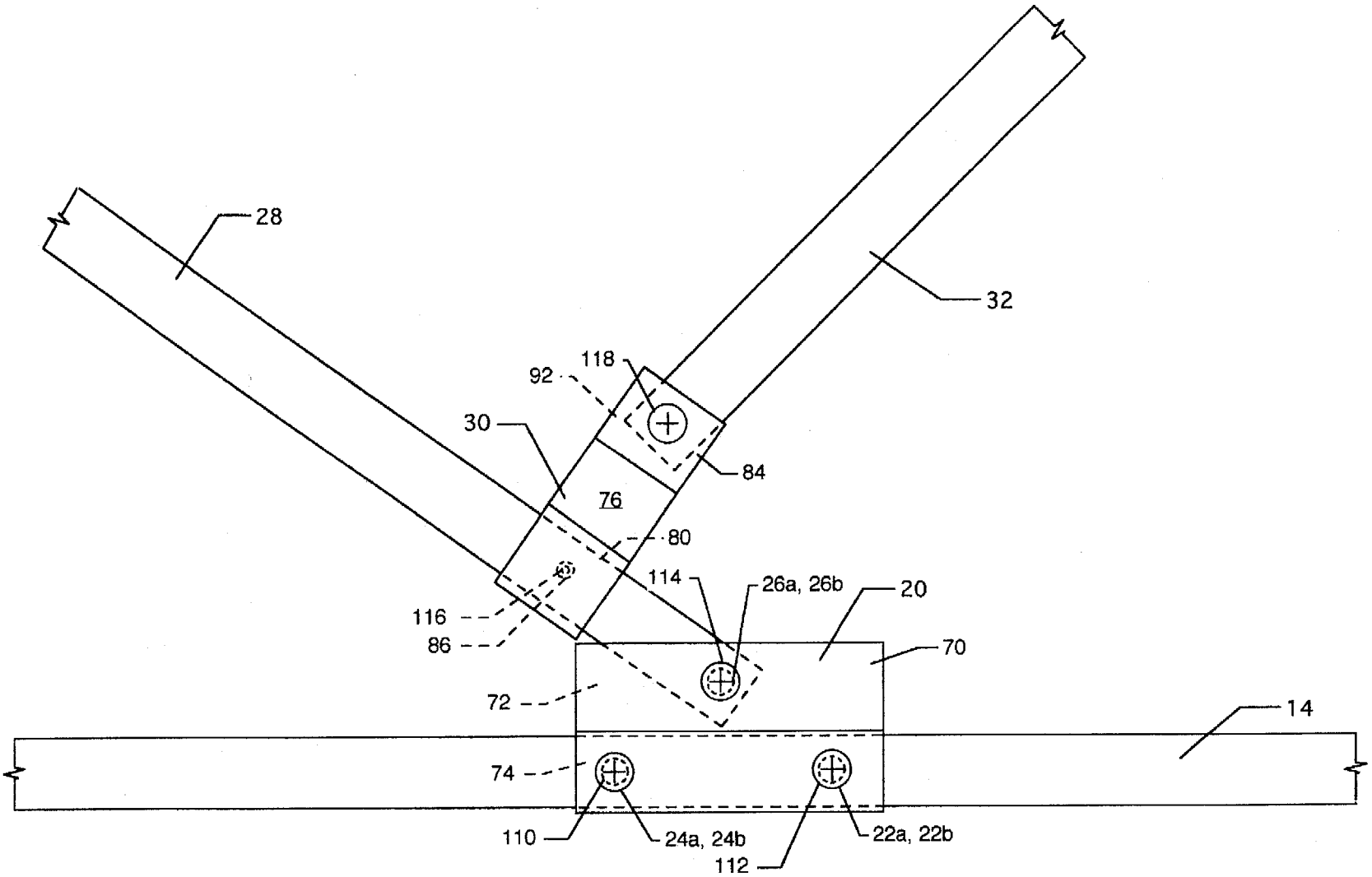
FIG. 7 is a view illustrating the manner in which the rear bow frame and the front bow frame members are secured to the railing framework via a long H-bracket.

A rear bow frame member 28 pivotally mounts to the long H-bracket 20, as illustrated in FIG. 7. The lower end of a transition bracket 30 secures over and about the lower region of the rear bow frame member 28. A front bow frame member 32 pivotally secures to the other end of the transition bracket 30.

Figure 8:
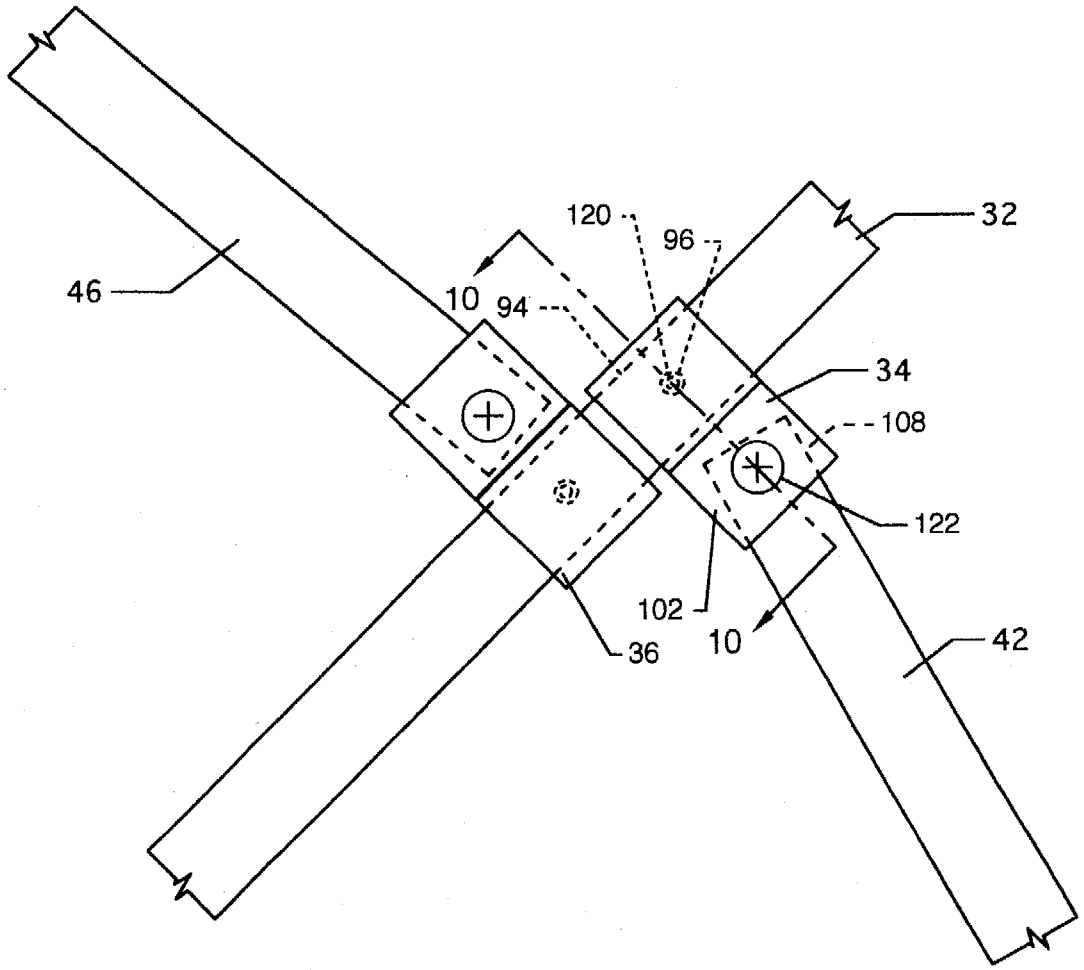
FIG. 8 is a view illustrating the manner in which the bow member and the support member are secured to the front bow frame member.

With reference to FIGS. 8, 1 and 2, pivot brackets 34, 36, 38 and 40 align and fastly secure over and about the front bow frame member 32 and the rear bow frame member 28, respectively. A support member 42 pivotally secures on one end to pivot bracket 34; the opposing end of support member 42 pivotally secures to a short H-bracket 44 secured by stainless steel hardware to the railing framework 14. One end of bow member 46 pivotally secures to pivot bracket 36 and the other end to the corresponding framework on the port side. One end of an optional pivot bracket 48, similar to brackets 34, 36, 38 and 40, secures over and about the lower mid-region of the bow member 46 to pivotally support one end of an optional bow member 50.

A support member 52 pivotally secures on one end to pivot bracket 38; the opposing end of support member 52 pivotally secures to a short H-bracket 54 secured by stainless steel hardware to the railing framework 14. One end of a bow member 56 pivotally secures to pivot bracket 40 and the other end to the corresponding framework on the port side. One end of an optional pivot bracket 58, similar to brackets 34, 36, 38 and 40, secures over and about the lower mid-region of the bow member 56 to pivotally support one end of an optional bow member 60.

All framework members and the railing frameworks are of 1¼ square aluminum tubing which fit in close tolerance to the long and short H-brackets and the pivot brackets to provide for maximum coupled stability. All H-brackets and pivot brackets are of thick wall construction to eliminate flex and to promote stability.

FIG. 3 is an isometric view of the extruded long H-bracket 20, where all numerals correspond to those elements previously described. A horizontally aligned planar web member 66 intersects vertically aligned wall members 68 and 70 to form an upper channel 72 and a lower channel 74. A body hole 26*a* and a threaded hole 26*b* align through the upper portion of wall members 70 and 68, respectively, to accommodate a bolt for pivotal mounting of framework members in the upper channel 72. Body holes 22*a* and 24*a*, and threaded holes 22*b* and 24*b*, align through the lower portion of wall members 70 and 68, respectively, to accommodate bolts for mounting of the long H-bracket 20 to the railing framework 14. Short H-brackets, such as H-bracket 44, have the same cross sectional profile as the long H-bracket 20, but are shortened, as illustrated in FIG. 4 and include only one set of lower bolt mounting holes.

Figure 4:
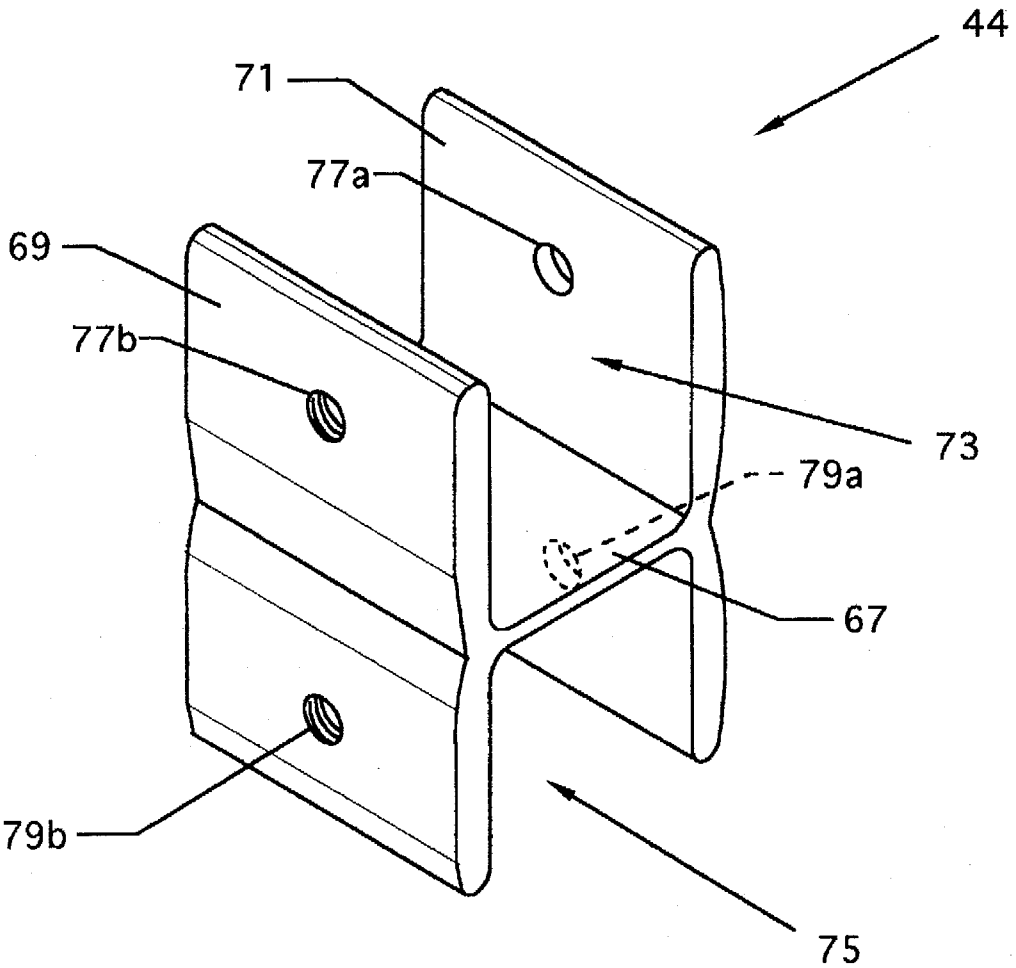
FIG. 4 is an isometric view of an extruded short H-bracket.

FIG. 4 is an isometric view of the short extruded H-bracket 44, where all numerals correspond to those elements previously described. The short extruded bracket 44 has a cross section similar to that of the long H-bracket 20, but is a shortened version thereof. A horizontally aligned planar web member 67 intersects vertically aligned wall members 69 and 71 to form an upper channel 73 and a lower channel 75. A body hole 77*a* and a threaded hole 77*b* align through the upper portion of wall members 71 and 69, respectively, to accommodate a stainless steel bolt or machine screw for pivotal mounting of framework members in the upper channel 73. Optionally, a removable pin can be inserted through holes 77*a* and 77*b* to provide for a quick disconnect of the support member 42 from the short H-bracket 44 when it is desired to collapse the majority of the frame 10 backwardly to an oblique position resting against rear bow frame member 28. The same mode of operation with short H-bracket 54 can be utilized if total collapsing of the frame 10 to the horizontal position is required, whereupon the entirely collapsed frame 10 positions along the rear portions of the railing frameworks 14 and 16. Body hole 79*a* and threaded hole 79*b* align through the lower portion of wall members 71 and 69, respectively, to accommodate a stainless steel mounting bolt or machine screw for mounting of the short H-bracket 44 to the railing framework 14.

Figure 5:
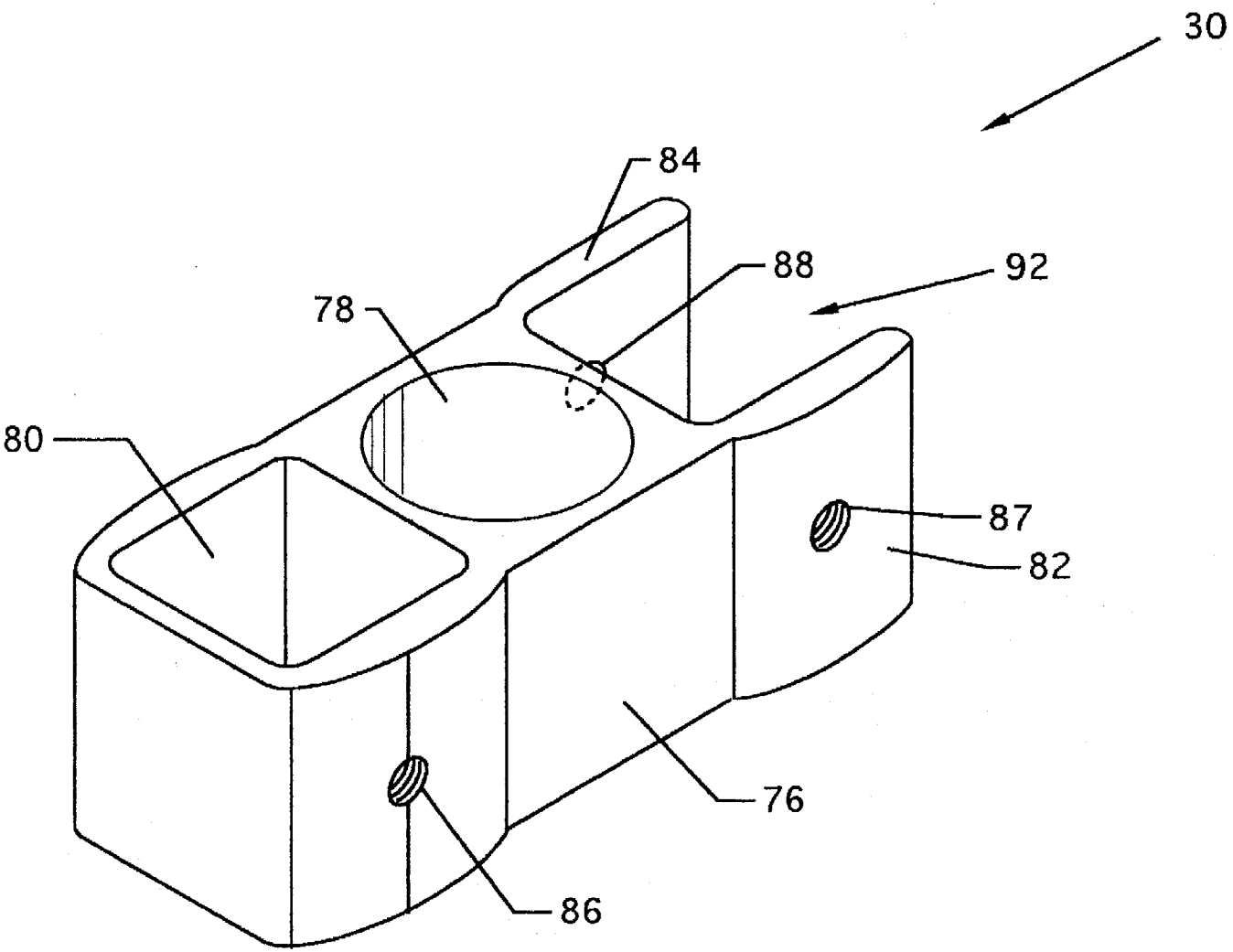
FIG. 5 is an isometric view of an extruded transition bracket.

FIG. 5 is an isometric view of a transition bracket, 30 where all numerals correspond to those elements previously described. The main body 76 includes a bore space 78. A square hole 80 aligns to one side of the main body 76 for accommodation of a framework member. Vertically oriented planar extensions 82 and 84 extend from the main body 76 to form a channel area 92 with one side of the main body 76. A threaded set-screw hole 86 extends through one side of the transition bracket leading to the square hole 80 for securement of a framework member in the square hole 80. A body hole 88 and a threaded hole 87 are included in the planar extensions 84 and 82, respectively, to pivotally secure a framework member to the channel area 92 of the transition bracket 30.

Figure 6:
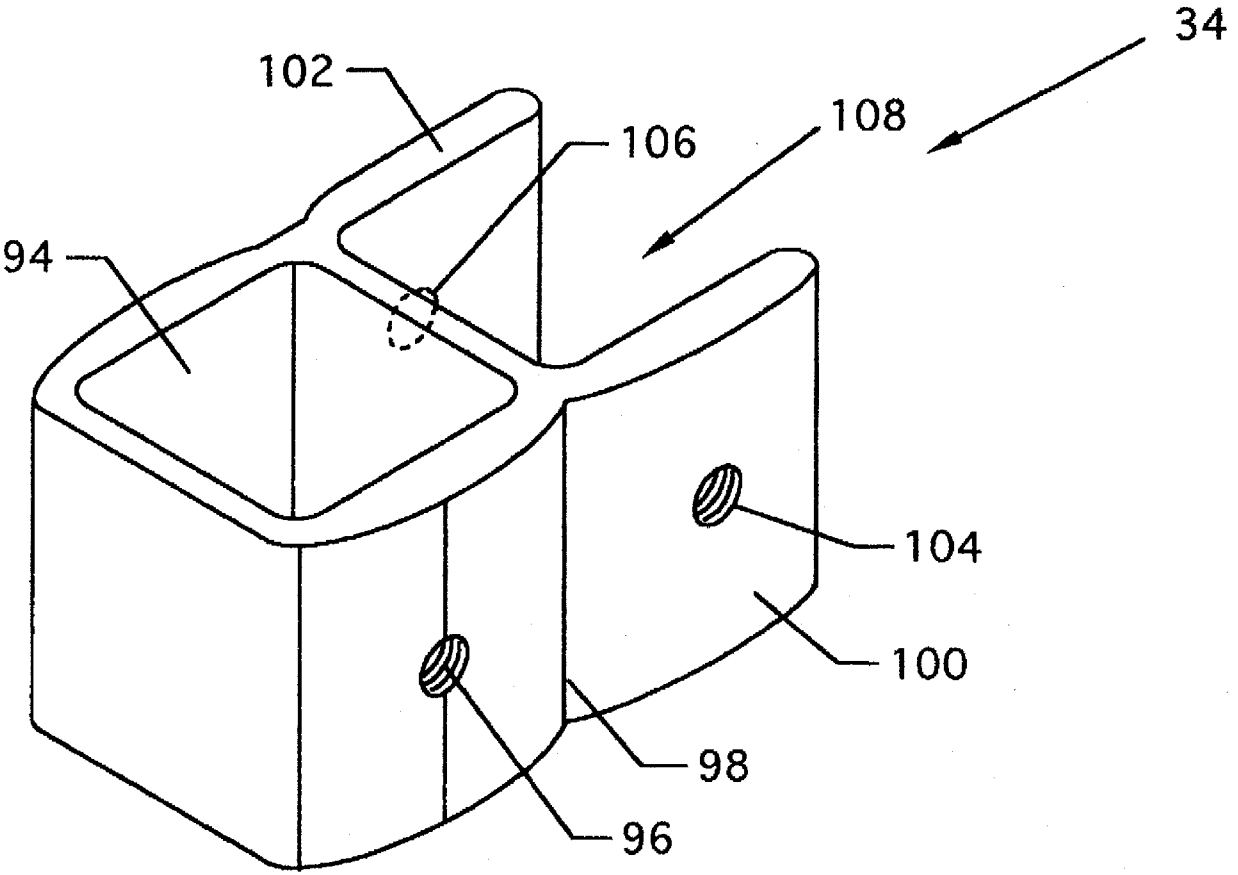
FIG. 6 is an isometric view of an extruded pivot bracket.

FIG. 6 is an isometric view of a pivot bracket 34, where all numerals correspond to those elements previously described. A square hole 94, similar in size to square hole 80 of the transition bracket 30, extends from the main body 98 and includes a threaded set screw hole 96. Square hole 94 accommodates a framework member which is secured therein by a set screw in the threaded set screw hole 96. Vertically oriented planar extensions 100 and 102 extend from the main body 98 to form a channel area 108 with one side of the main body 98. A body hole 106 and a threaded hole 104 are included in the planar extensions 102 and 100, respectively, to pivotally secure a framework member to the channel area 108 of the pivot bracket 34.

Figure 9:
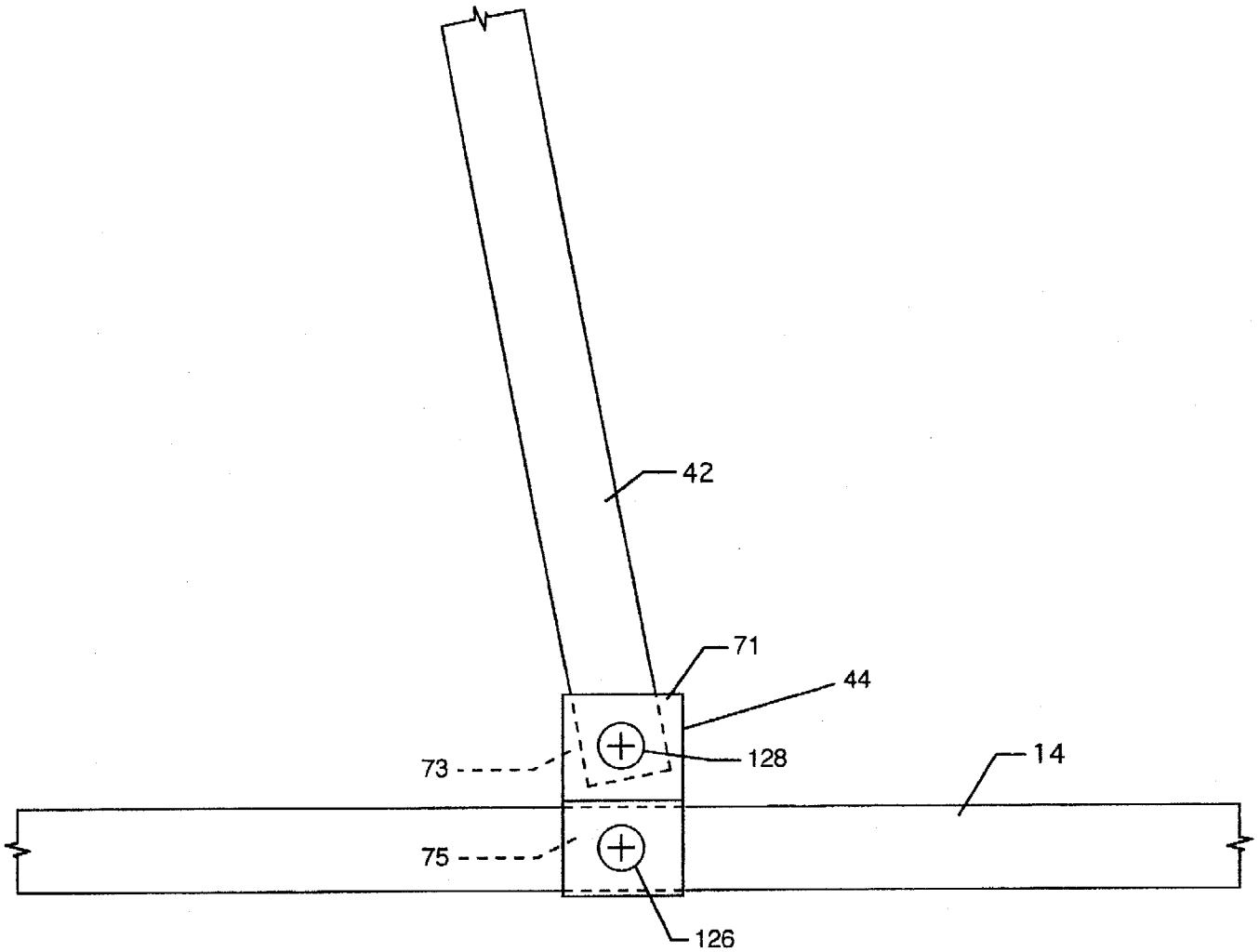
FIG. 9 is a view illustrating the manner in which the support member is secured to the railing framework via a short H-bracket; and, FIG. 10 is a cross sectional view of a pivot bracket along line 10—10 of FIG. 8.

FIGS. 7, 8 and 9 illustrate the method of attachment of various style brackets and associated components to various framework members as typically incorporated in the invention.

FIG. 7 illustrates the mounting of the rear bow frame member 28 and the front bow frame member 32 to the railing framework 14, where all numerals correspond to those elements previously described. The lower channel 74 aligns over and about the railing framework 14. Bolts 110 and 112 engage holes 24*a* and 24*b*, and holes 22*a* and 22*b*, of the long H-bracket 20, as well as appropriate holes in the railing framework 14 to secure the long H-bracket 20 to the railing framework. Electrolysis forms a chemical bond between the threads of the bolts and the corresponding threaded screw holes 22*b* and 24*b* in the long H-bracket 20 to assist in thread-to-thread securement. In addition, body holes 22*a* and 24*a* can be closely fitted to the bolt diameters to effect a similar chemical bond. Bolt 114 engages holes 26*a* and 26*b* in a similar fashion and extends also through holes in the rear bow frame member 28 to pivotally secure the rear bow frame member 28 to the long H-bracket 20. The square hole 80 closely engages the lower portion of the rear bow frame member 28 and is secured therein by a set screw 116 in set screw hole 86. One end of the front bow frame member 32 is pivotally secured in the channel area 92 of the transition bracket 30 by stainless steel bolt 118 accommodated by holes 88 and 87 (of FIG. 5) and through appropriate holes at the end of the front bow frame member 32. Again, chemical bonding at the threaded junction occurs to assist in securement of the bolt 118 with the transition bracket 30.

FIG. 8 illustrates the securement of the bow member 46 and the support member 42 to the front bow frame member 32, where all numerals correspond to those elements previously described. Square hole 94 of pivot bracket 34 closely engages the front bow frame member 32 and is secured thereto by a stainless steel set screw 120 in set screw hole 96. A stainless steel bolt 122 is accommodated by holes 106 and 104 in the pivot bracket 34 and appropriate holes in the end of the support member 42 to pivotally secure the support member 42 in the channel area 108. Pivot bracket 36 aligns and secures in a similar fashion over and about the front bow frame member 32. Bow member 46 is pivotally secured to the pivot bracket 36 in the same manner as that just described.

FIG. 9 illustrates the mounting of support member 42 to railing framework 14 via a short H-bracket 44, where all numerals correspond to those elements previously described. A bolt 126 is accommodated by holes 79*a* and 79*b* in the walls of the lower channel 75 which fits over and about the railing framework 14, and appropriate holes in the railing framework 14 to secure the short H-bracket 44 to the railing framework 14. A bolt 128 is accommodated by holes 77*a* and 77*b* and holes in the end of the support member 42 to pivotally secure the support member 42 within the upper channel 73.

Figure 10:
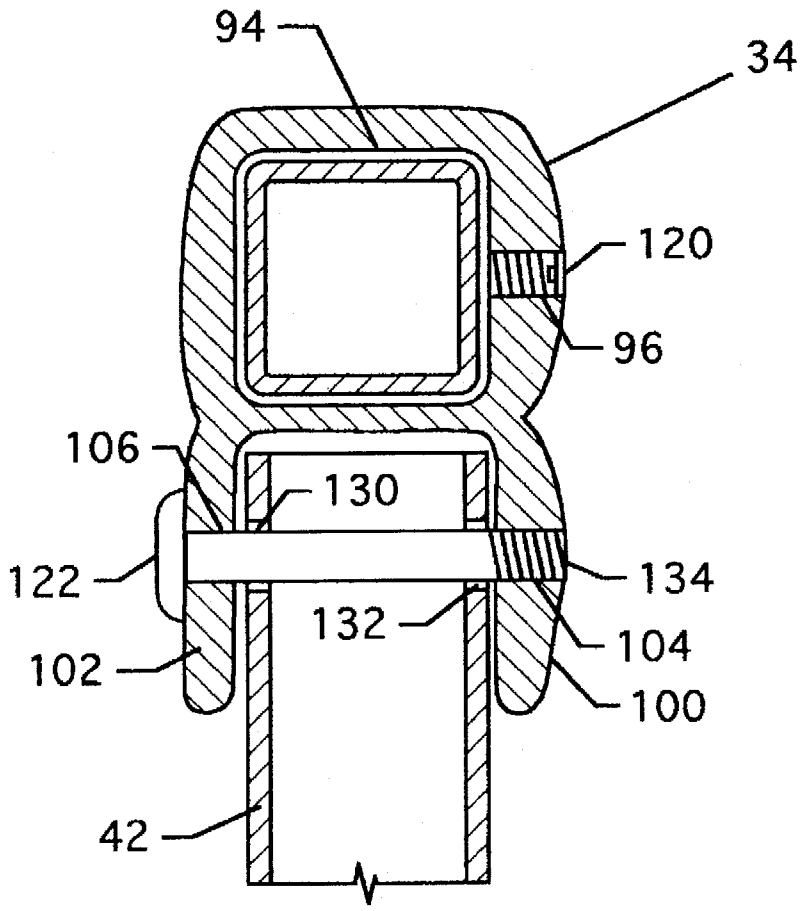

FIG. 10 is a cross sectional view of the short H-bracket 44 along line 10—10 of FIG. 8, where all numerals correspond to those elements previously described. Stainless steel set screw 120, having a cup point 121, is tightened in set screw hole 96 to secure the front bow frame member 32 within the square hole 94. Electrolysis forms a chemical bond between the threaded set screw hole 96 of the extruded aluminum pivot bracket 34 and threads of the stainless steel set screw 120. Stainless steel bolt 122 is illustrated in alignment in holes 106 and 104, as well as through holes 130 and 132 in the support member 42. Electrolysis forms a chemical bond between the threaded hole 104 of the extruded aluminum pivot bracket 34 and the threads 134 of the stainless steel bolt 122.

We claim:

1. A sun top frame for a pontoon boat comprising:

a. a rear frame member with frictionally engaged opposing large brackets;

b. a front frame member pivotally secured to said opposing large brackets;

c. opposing small brackets frictionally engaged over said rear frame member and said front frame member;

d. opposing rear supports and opposing front supports engaged into said opposing small brackets;

e. opposing long H-brackets pivotally secured to each end of said rear frame member; and, f. opposing short H-brackets pivotally secured to an end of each of said rear supports and to an end of each of said front supports.

2. A sun top frame for a pontoon boat comprising:

a. a rear frame member with frictionally engaged opposing large brackets;

b. a front frame member pivotally secured to said opposing large brackets;

c. opposing small brackets frictionally engaged over said rear frame member and said front frame member;

d. opposing rear supports and opposing front supports engaged into said opposing small brackets;

e. opposing long H-brackets pivotally secured to each end of said rear frame member;

f. opposing short H-brackets pivotally secured to an end of each of said rear supports and to an end of each of said front supports; and, g. additional opposing small brackets frictionally engaged over said rear frame member and over said front frame member, and a small rear frame member and a small front frame member pivotally engaged into said additional opposing small brackets.

* * * * *